US005262124A

United States Patent [19]

Yamaji et al.

[11] Patent Number: 5,262,124

[45] Date of Patent: Nov. 16, 1993

[54] ALLOY SUITED FOR USE IN WATER SERVICE AND HAVING IMPROVED MACHINABILITY AND FORMING PROPERTIES

[75] Inventors: Kenkichi Yamaji; Rokuro Kawanishi, both of Tokyo, Japan

[73] Assignee: Hitachi Alloy, Ltd., Tokyo, Japan

[21] Appl. No.: 751,935

[22] Filed: Sep. 3, 1991

[30] Foreign Application Priority Data

Mar. 30, 1991 [JP] Japan ..... 3-93493

[51] Int. Cl.[5] ..... C22C 9/04

[52] U.S. Cl. ..... 420/477; 420/491; 148/413; 148/434

[58] Field of Search ..... 420/477, 491; 148/413, 148/434

[56] References Cited

FOREIGN PATENT DOCUMENTS 1921124 9/1957 Austria .
0132196 9/1978 German Democratic Rep. ..... 420/477
492578 11/1975 U.S.S.R. .
1007164 10/1965 United Kingdom .
1193201 5/1970 United Kingdom .
2211206 6/1989 United Kingdom .

OTHER PUBLICATIONS

*Woldman's Engineering Alloys*, 6th Edition, Robert C. Gibbons, editor; American Society for Metals, 1979, p. 1776.

*Primary Examiner*—R. Dean
*Assistant Examiner*—Robert R. Koehler
*Attorney, Agent, or Firm*—Lowe, Price, LeBlanc & Becker

[57] ABSTRACT

An alloy suited for use in water service, having less tendency for lead to dissolve in water, free cutting property and freedom from gravity segregation in casting and cracks caused by forming is provided. The alloy according to the invention comprises about 60 weight % of copper, 0.5 to 3.5 weight % of lead, at least one rare earth metal in an amount of 1/17 to 1/5 relative to lead in weight and zinc for the rest. The lead content is preferably at most 3.0% for less dissolution of lead into water, while less than 3.0% of lead is preferred for hot forged alloys.

4 Claims, 14 Drawing Sheets

X 300

X 2000 f d e

ALLOY SUITED FOR USE IN WATER SERVICE AND HAVING IMPROVED MACHINABILITY AND FORMING PROPERTIES

FIELD OF THE INVENTION

The present invention relates to an alloy suited for use in water service, particularly to an alloy having less tendency for lead to dissolve in water, free cutting property and freedom from gravity segregation in casting and cracks caused by forming.

BACKGROUND OF THE INVENTION

Lead-bearing brass, a Cu-Zn-Pb ternary alloy, is widely used for industrial materials because of its free cutting property. The lead content of the alloy is adjusted taking account of cutting properties required. For instance, four kinds of free-cutting brass are defined in Japanese Industrial Standards.

A lead content of 3.0 to 3.5 weight % is said to be most effective to obtain free cutting property. These Cu-Zn-Pb ternary alloys are mainly used for livelihood devices and tools, especially for materials coming into contact with water, such as in devices for water supply. Lead-bearing brass, however, allows lead to dissolve into water in contact with the alloy used in tap devices. Such lead dissolution must be taken into account from the view point of environmental hygiene. Recently, the progress in water source development leads to a greater variety in quality of tap water. Further, hot water is used more widely as the hot water equipments are more and more popular. Therefore, the quality and the temperature of water must be taken into account in connection with lead dissolution.

There are other problems attended with lead-bearing brass. Casting of lead-bearing brass results in, sometimes, gravity segregation owing to the difference in density between lead and brass (the density of lead is 9.81 and that of brass is 7.32 at 1000° C.), as well as uneven distribution and particle size of lead between outer and inner parts of an ingot of a larger size designed for greater efficiency of production, due to the difference in cooling rate within the ingot, causing fluctuation of product quality. Lead-bearing brass also suffers from occasional fracturing in the course of hot forging or other hot forming, while cold working subsequent to a hot process also causes cracks. Such fracture may be attributed to the distribution state of lead deposited in grain boundaries (or sub-grain boundaries) in the solidified alloy because lead does not form a solid solution with either copper or zinc. Free cutting property is also impaired remarkably by a hot process such as hot extrusion and heat annealing due to coagulation of lead particles during the heating.

SUMMARY OF THE INVENTION

Accordingly, an object of the invention is to provide an alloy having less tendency for lead to dissolve in water in no relation to the quality and the temperature of water and free from gravity segregation and uneven distribution of lead within an ingot in casting and from cracks caused by cold working.

A further object of the invention is to provide an alloy having improved free cutting property.

A still further object of the invention is to provide an alloy free from fracturing caused by hot forging.

According to a feature of the invention, an alloy comprises 57 to 61 weight % of copper, 0.5 to 3.5 weight % of lead, at least one metal selected from rare earth metals in an amount of 1/17 to 1/5 relative to lead in weight and zinc for the rest. .

According to another feature of the invention, an alloy comprises 57 to 61 weight % of copper, at least 0.5 weight % but less than 3.0 weight % of lead, at least one metal selected from rare earth metals in an amount of 1/17 to 1/5 relative to lead in weight and zinc for the rest.

BRIEF DESCRIPTION OF THE DRAWINGS

The invention will be explained in conjunction with appended drawings wherein.

DESCRIPTION OF THE PREFERRED EMBODIMENTS

Figure 1A:
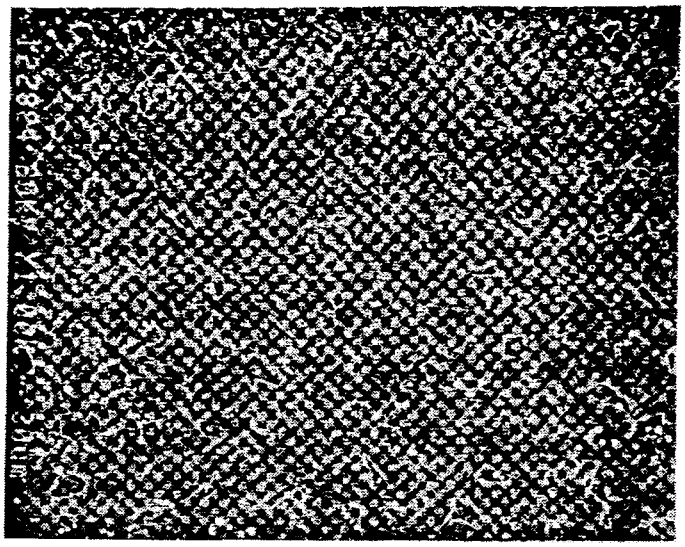
FIGS. 1A to 1C are metallographs of a preferred embodiment of an alloy according to the invention.

It is preferred that the alloy according to the invention contains 0.5 to 3.0 weight % of lead in order to achieve less tendency for lead to dissolve in water in no relation to the quality and the temperature of water. An alloy containing at least 0.5 weight % but less than 3.0% of lead is preferable to prevent fracturing caused by hot forging. The lead content greater than 0.5% but at most 2.0% is more preferred to prevent fracturing by hot forging.

Improved free cutting property is achieved by an alloy according to the invention which contains 0.5 to 3.5 weight % of lead.

Among rare earth metals, lanthanum, cerium, praseodymium and Neodymium are preferable. So called Misch metal containing these metals may be used.

Rare earth metals in the alloy according to the invention form intermetallic compounds with any of copper, zinc and lead, of which those formed with lead have melting points higher than those formed with copper or zinc, indicating greater thermal stability of the compounds. Some examples are shown in Table 1. It is supposed that intermetallic compounds of rare earth metals with lead are formed more readily than those with copper or zinc, such intermetallic compounds formed serve as crystal nuclei to form crystals more finely dispersed and make the dispersed phase as a whole more uniform and fine, and thus, either cold working or hot forging does not cause cracks or fracture due to the deposition of lead in grain boundaries which is observed in conventional Cu-Zn-Pb alloys.

TABLE 1

| Composition of intermetallic compound | | |
|---|---|---|
| Chemical formula | Weight ratio of rare earth metal | Melting point (°C.) |
| $CeCu_6$ | 26.88(%) | 940 |
| $CeCu_4$ | 35.54 | 780 |
| $CeCu_2$ | 52.44 | 820 |
| CeCu | 68.80 | 515 |
| $LaCu_4$ | 35.34 | 902 |
| $LaCu_3$ | 42.16 | 793 |
| $LaCu_2$ | 52.23 | 834 |
| LaCu | 68.62 | 551 |
| $CeZn_{11}$ | 16.31 | 785 |
| $CeZn_7$ | 19.23 | 972 |
| $CeZn_5$ | 30.00 | 870 |
| $LaZn_6$ | 20.00 | 974 |
| $LaZn_4$ | 35.00 | 872 |
| $LaZn_2$ | 51.59 | 855 |
| LaZn | 68.00 | 815 |
| $CePb_3$ | 18.40 | 1170 |
| $Ce_2$ Pb | 57.49 | 1380 |
| $LaPb_3$ | 18.37 | 1030 |
| LaPb | 40.14 | 1246 |
| $La_2$ Pb | 57.28 | 1315 |

Further, it is supposed that such intermetallic compounds formed by the rare earth metals added to a Cu-Zn-Pb alloy lead to a reduced number and amount of free Pb phase formed in the alloy, some of which may be present locally in the particles attached to those of intermetallic compounds to form composite particles, resulting in reduced amount of lead dissolved in water.

The invention will be explained in more detail by way of examples hereinbelow.

EXAMPLES 1 AND 2

Two preferred embodiments of this invention are alloys of the composition indicated in Table 2. R.E. in the table denotes Misch metal.

TABLE 2

| | Chemical composition (wt. %) | | | | |
|---|---|---|---|---|---|
| Examples | Cu | Pb | R.E | Zn | R.E./Zn |
| 1 | 59.5 | 3.0 | 0.60 | rest | 1/5 |
| 2 | 60.0 | 2.0 | 0.133 | rest | 1/15 |

The alloys are produced by the following procedure. Brass consisting of 60 weight % of copper and 40 weight % of zinc is melted in air, a predetermined amount of lead and Misch metal (R.E.) is added to the melt, the melt is casted in a mold of Isolite refractory to form an alloy ingot, which is cold-worked to permit reduction of 15% to form a round rod of 10 mm in diameter, heated at 700° C. for 1 hour or 3 hours, respective to each sample, and air-cooled at last. Metallographic observation was made with a cross-section of the round rod.

Figure 1B:
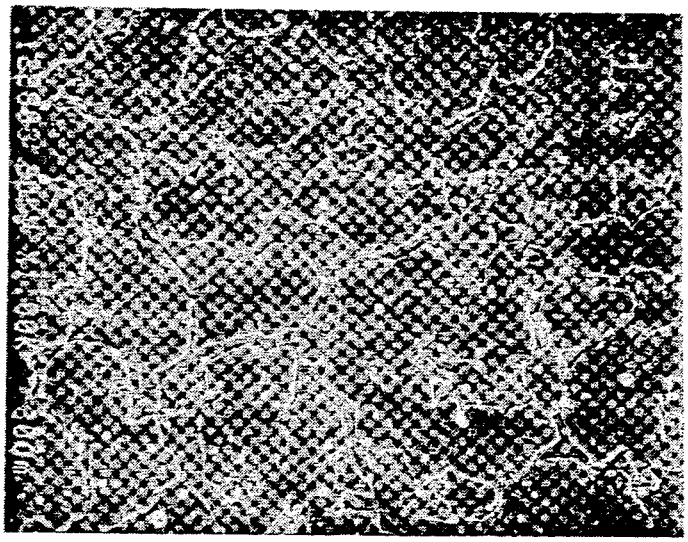
Figure 1C:
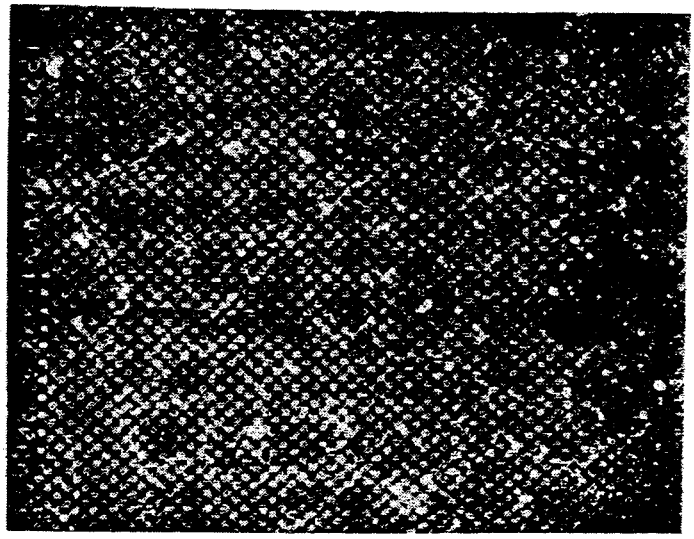
Figure 2A:
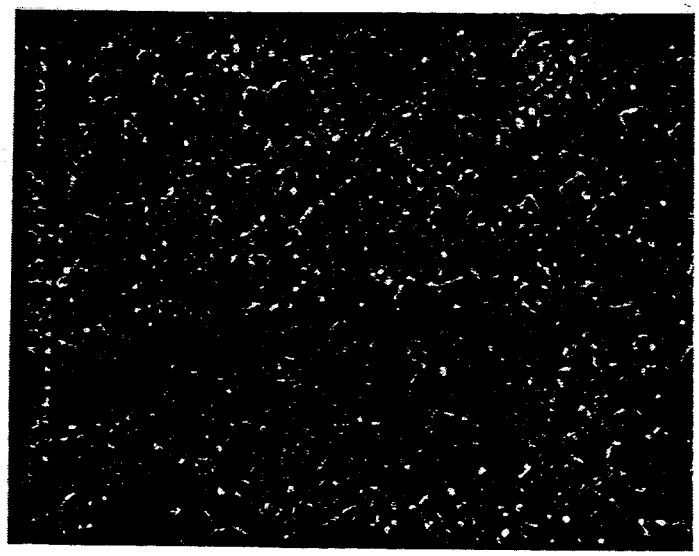
FIGS. 2A to 2C are metallographs of another preferred embodiment of an alloy according to the invention.
Figure 2B:
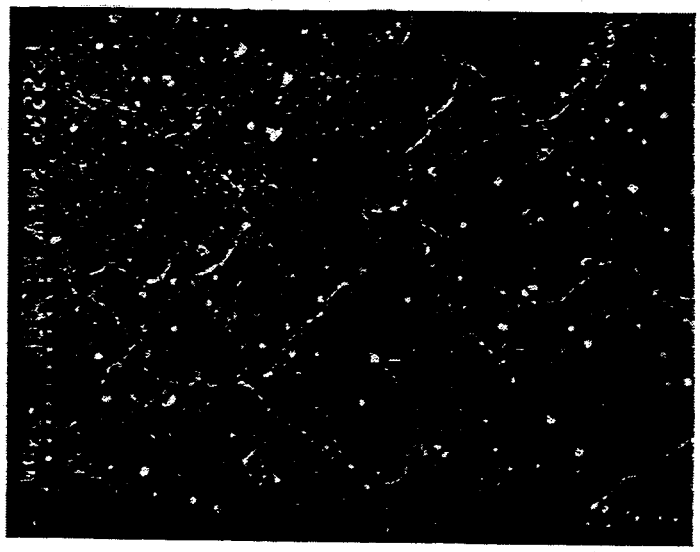
Figure 2C:
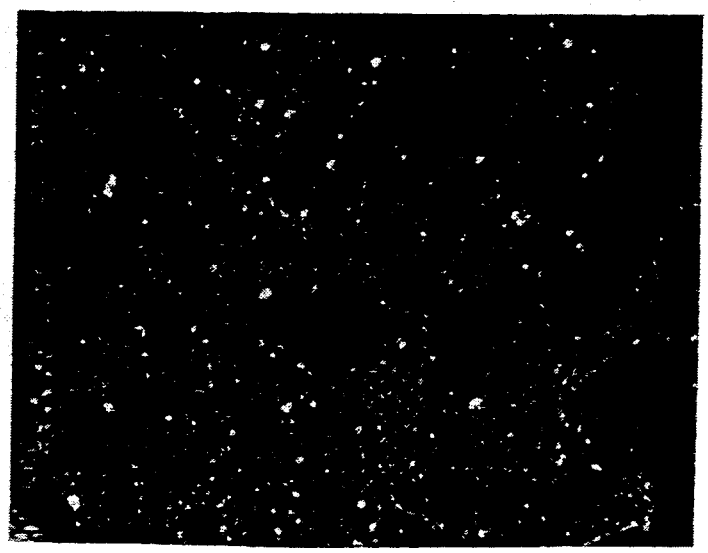

FIGS. 1A, 1B and 1C show microscopic metallographs of alloys of Example 1 without heating, after heating for 1 hour and 3 hours at 700° C., respectively. FIGS. 2A, 2B and 2C show microscopic metallographs of alloys of Example 2 without heating, after heating for 1 hour and 3 hours at 700° C., respectively. As shown in these micrographs, very finely dispersed particles are observed which appears to consist of lead or intermetallic compound are dispersed very finely. The dispersion is found to be still fine after heating, through the grains have grown slightly by heat treatment. The alloys of Example 1 are less susceptive to heat than that of Example 2 with respect to metallographic structure.

COMPARISON EXPERIMENT

A conventional lead-bearing brass whose composition is shown in Table 3 was prepared as alloy C-1 for comparison and cold worked in the same manner as in Examples 1 and 2.

TABLE 3

| | Chemical composition (wt. %) | | | |
|---|---|---|---|---|
| Alloy | Cu | Pb | R.E | Zn |
| C-1 | 59.5 | 3.0 | — | rest |

Figure 3A:
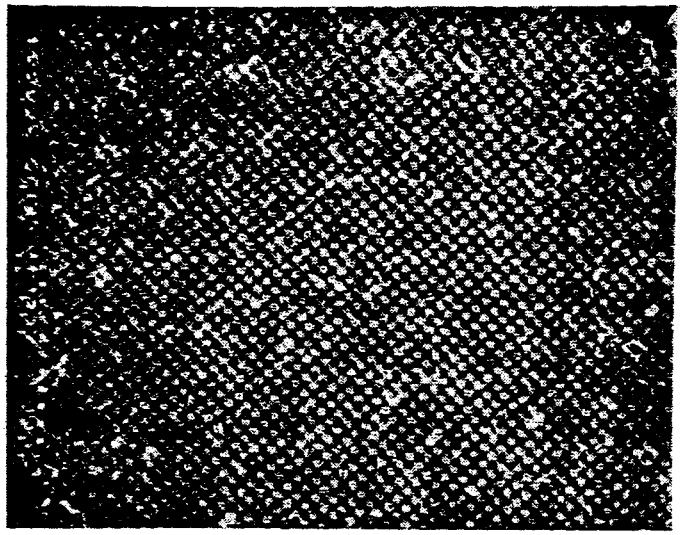
FIGS. 3A to 3C are metallographs of a conventional lead-bearing brass.
Figure 3B:
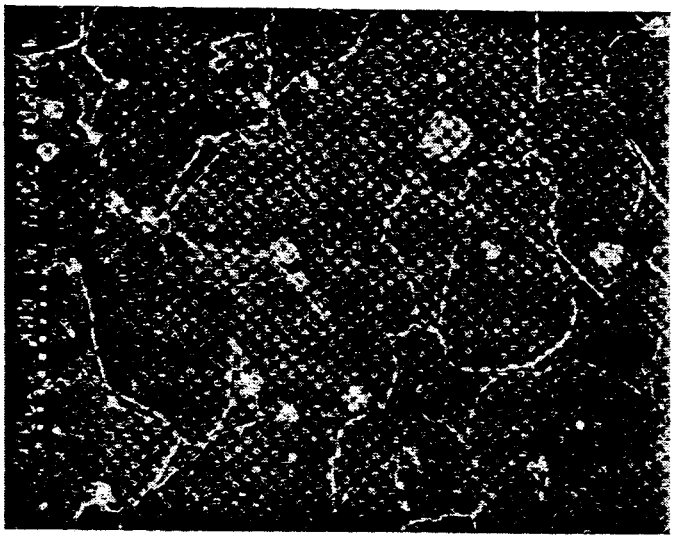
Figure 3C:
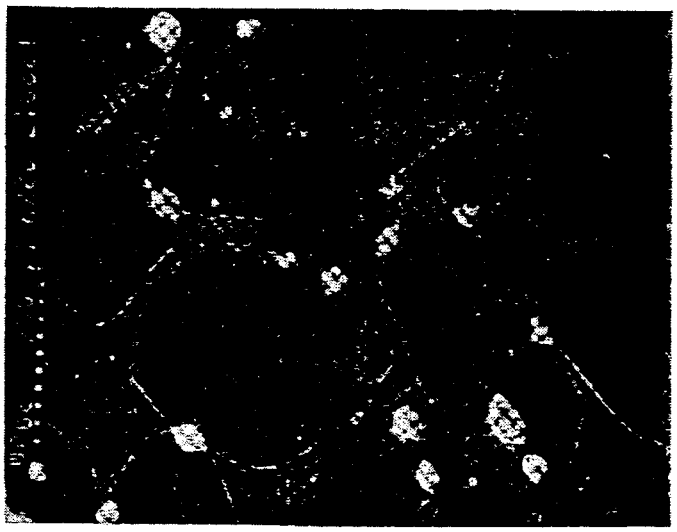

FIGS. 3A, 3B and 3C show microscopic metallographs of the conventional lead-bearing brass for comparison without heating, after heating for 1 hour and 3 hours at 700° C., respectively. The grains have grown in the course of heating, and also the particles of lead are coagulated in grain boundaries.

EXAMPLE 3

Figure 4A:
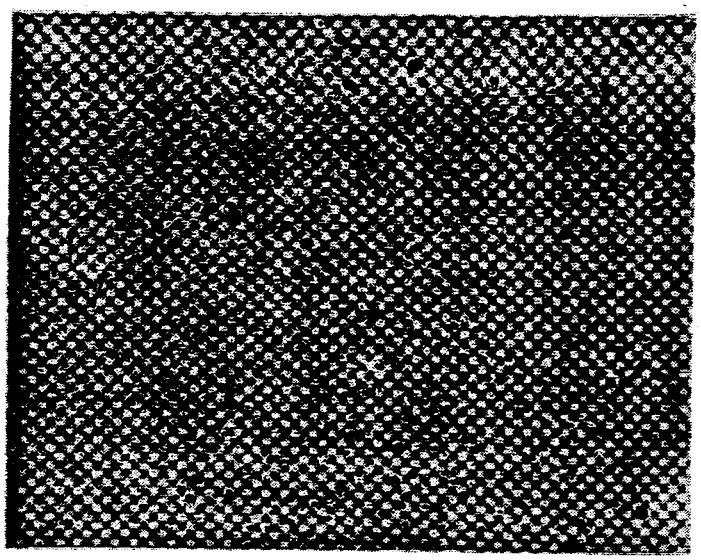
FIGS. 4A to 4C are metallographs after casting of a still further preferred embodiment of an alloy according to the invention and other alloys for comparison.

An alloy of the composition indicated in Table 4 is prepared in the same manner as in Examples 1 and 2, but the diameter of the ingot was 30 mm (R.E. in the table denotes Misch metal). Metallographic observation was made with a cross-section of the round rod. A microscopic metallograph obtained is shown in FIG. 4A.

TABLE 4

| | Chemical composition (wt. %) | | | | |
|---|---|---|---|---|---|
| Example | Cu | Pb | R.E | Zn | R.E./Zn |
| 3 | 59.4 | 2.1 | 0.30 | rest | 1/7 |

QUANTITATIVE MEASUREMENTS OF THE GRAIN STRUCTURE

Figure 4B:
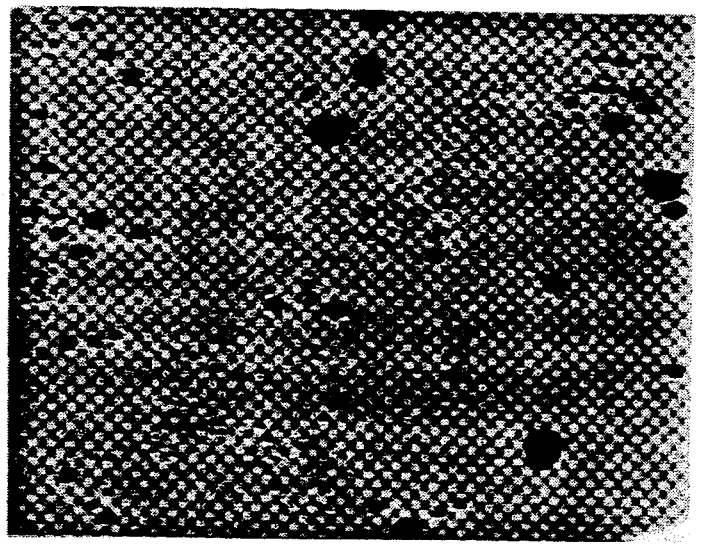
Figure 4C:
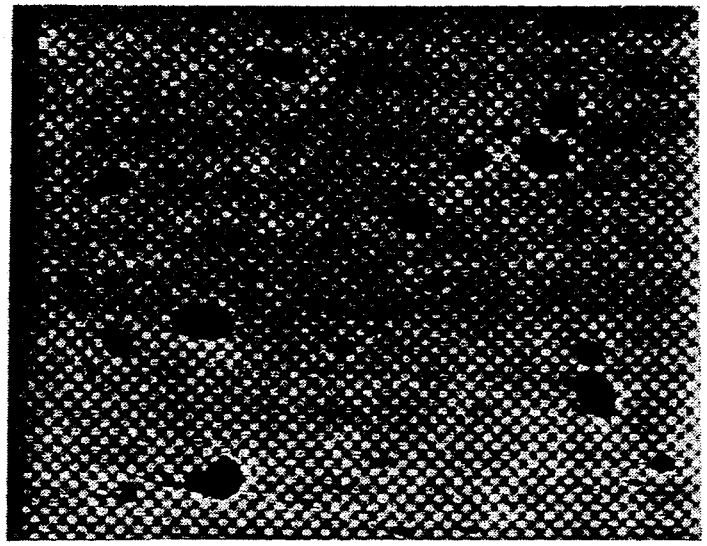

An alloy C-2 containing Cu, Zn, Pb and less amount of Misch metal and a lead-bearing brass C-3 were prepared for comparison. Their compositions are shown in Table 5 (R.E. denotes Misch metal). Microscopic metallographs of these alloys are shown in FIG. 4B and FIG. 4C.

TABLE 5

| | Chemical composition (wt. %) | | | | |
|---|---|---|---|---|---|
| Alloy | Cu | Pb | R.E | Zn | R.E./Zn |
| C-2 | 58.8 | 2.2 | 0.10 | rest | 1/22 |
| C-3 | 59.0 | 2.1 | 0 | rest | 0 |

The number of dispersed phase in a constant area of the metallograph and the average particle size were measured for the alloy of Example 3, alloy C-2 and alloy C-3. The results obtained are shown in Table 6.

TABLE 6

| Alloys | Number of dispersed phase | Average particle size ($\mu m^2$) |
|---|---|---|
| Example 3 | 789 | 27.1 |
| C-2 | 275 | 78.8 |

TABLE 6-continued

| Alloys | Number of dispersed phase | Average particle size ($\mu m^2$) |
|---|---|---|
| C-3 | 138 | 168.7 |

The effect of a rare earth metal to minimize the size of dispersed phase is indicated in Table 6, but 1/22 by weight of Misch metal relative to lead is not sufficient.

Figure 5A:
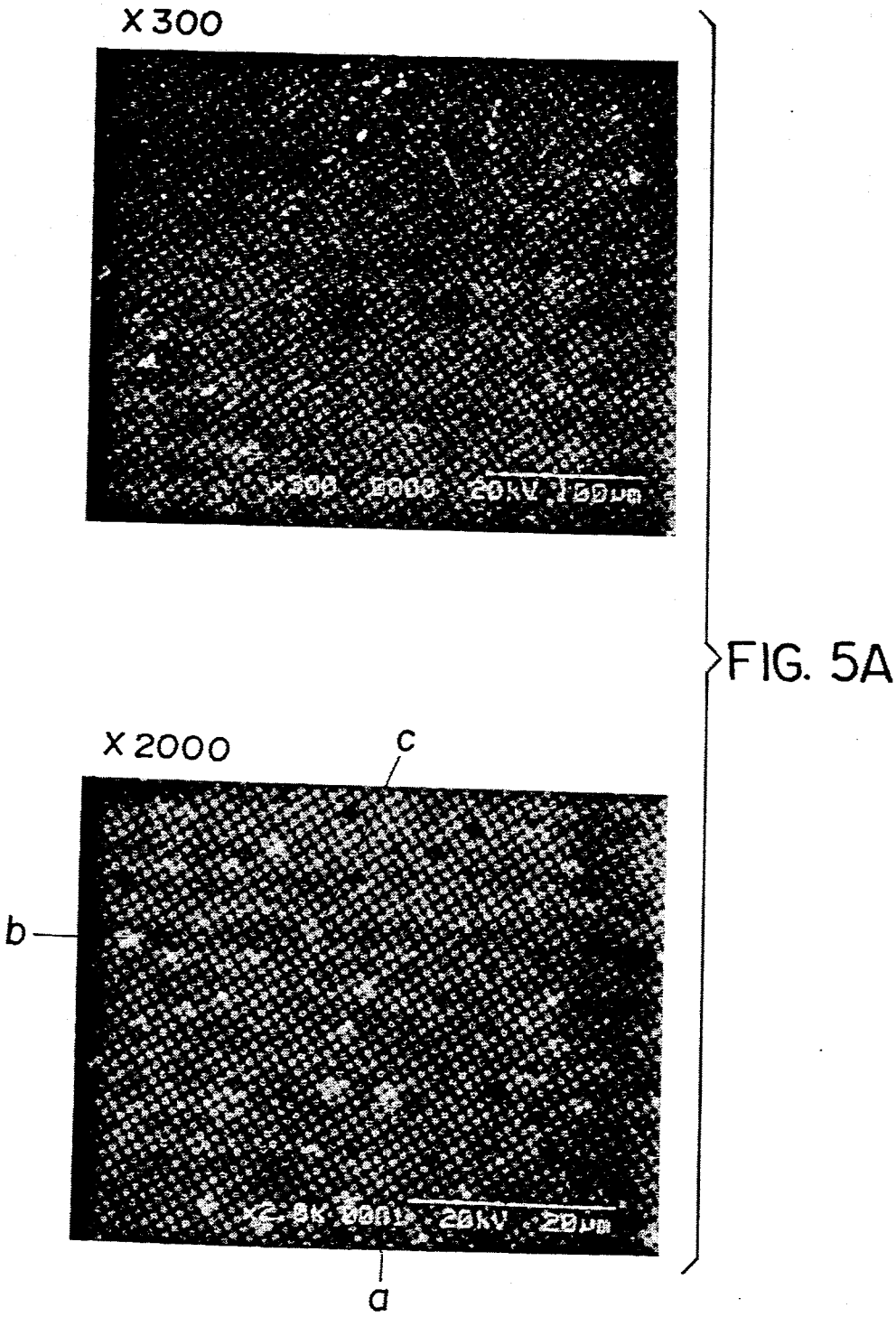
FIG. 5A and FIG. 5B are electron-microscopic metallographs of a still further embodiment of an alloy according to the invention and another alloy for comparison, FIG. 6A
Figure 5B:
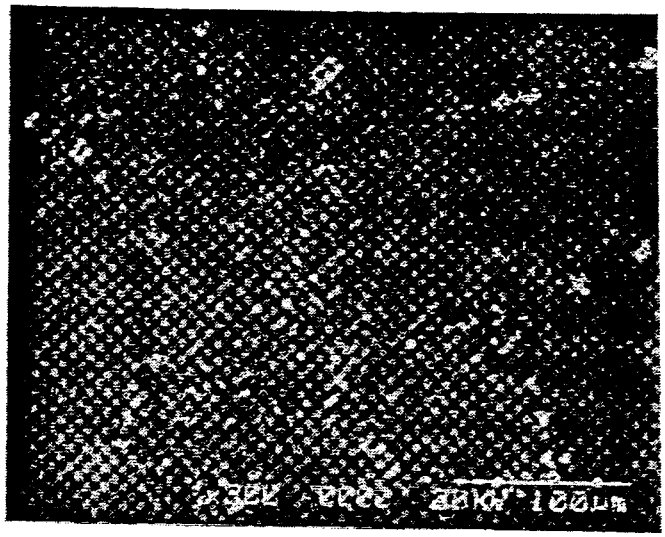
Figure 5B:
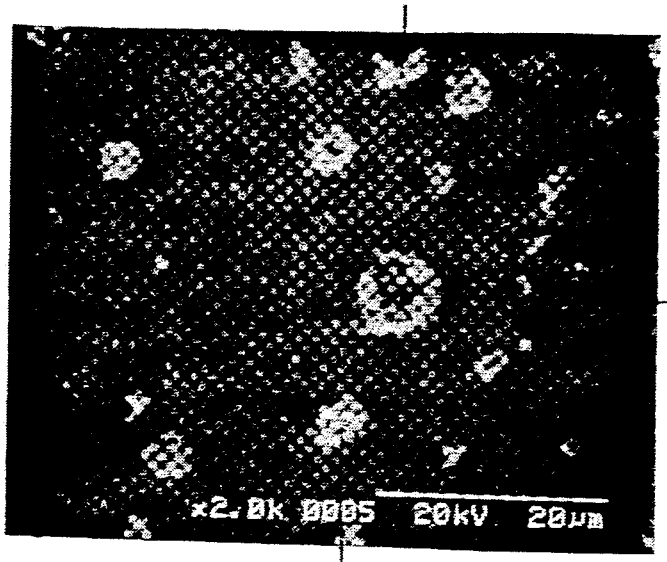

Electron-micrographic observation and X-ray microanalysis of the dispersed phase in each of the two alloys, Example 3 and alloy C-2, were made. Electron-micrograph of Example 3 and alloy C-2 are shown in FIG. 5A and FIG. 5B, respectively. The results of X-ray microanalysis are shown in Table 7, where particles a, b, c, d, e and f are those indicated in FIG. 5A and FIG. 5B.

TABLE 7

| Alloy | Particle | Part | Content (wt. %) Pb | Ce |
|---|---|---|---|---|
| Example 3 | a | | 88.06 | 11.94 |
| | b | | 89.06 | 10.94 |
| | c | | 88.54 | 11.46 |
| C-2 | d | central | 89.04 | 10.96 |
| | | outer | 99.88 | 0.12 |
| | e | central | 88.90 | 11.10 |
| | | outer | 100.0 | 0.0 |
| | f | central | 100.0 | 0.0 |

As shown in the electron micrograph of FIG. 5A, the dispersed phase is more fine in comparison to that of alloy C-2 containing less amount of Misch metal shown in FIG. 5B. The results of X-ray microanalysis in Table 7 indicate that an intermetallic compound of definite composition is formed in dispersed state in the alloy of this invention, whereas no intermetallic compound is formed in some of the dispersed particles (see Particle f) in alloy C-2 containing less amount of Misch metal, or otherwise, even if intermetallic compound is formed, it is confined to the central part of the particle (see Particles d and e). The intermetallic compound formed in the alloy of Example 3 is estimated to be $CePb_3$, taking account of the accuracy of analysis.

LEAD DISSOLUTION TESTS

Alloys of compositions shown in Table 8 were prepared and formed into round rods for lead dissolution tests. Alloys 2 to 4 and 6 to 8 are the alloys according to the invention, while alloys 1 and 5 are conventional lead-bearing brass without rare earth metals.

TABLE 8

| Alloy No. | Chemical composition (wt. %) Cu | Pb | R.E. | Zn | M.M./Pb |
|---|---|---|---|---|---|
| 1 | 59.5 | 1.0 | — | rest | — |
| 2 | 59.5 | 1.0 | 0.07 | rest | 1/14 |
| 3 | 59.5 | 1.0 | 0.10 | rest | 1/10 |
| 4 | 59.5 | 1.0 | 0.20 | rest | 1/5 |
| 5 | 59.5 | 3.0 | — | rest | — |
| 6 | 59.5 | 3.0 | 0.20 | rest | 1/15 |
| 7 | 59.5 | 3.0 | 0.30 | rest | 1/10 |
| 8 | 59.5 | 3.0 | 0.60 | rest | 1/5 |

The specimen of each alloy was prepared by the following procedure. Brass consisting of 60 weight % of copper and 40 weight % of zinc was melted by low frequency induction furnace; a predetermined amount of lead and Misch metal (R.E.) was added to the melt; the melt was casted semi-continuously in a vertical mold to form an ingot of 115 mm in diameter; and the ingot was hot extruded to form a round rod of 28 mm in diameter and reduced in diameter to 25 mm by cold drawing and annealed.

Figure 6A:
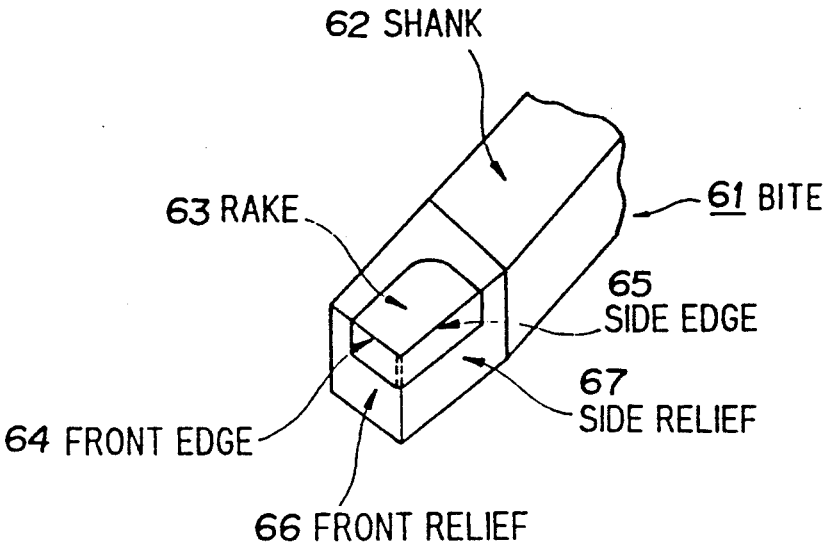
FIG. 6B is a perspective view showing a bite used for cutting of alloy piece in the machinability tests.

The specimen thus prepared were cut by turning to form a rod of 20 mm in diameter. Cutting was carried out at a speed of 2000 rotations per minute and a feed rate of 0.1 mm per rotation, making use of a bite of tungsten carbide, the shape of which is shown in FIG. 6A. The bite 61 includes shank 62, rake 63 having front edge 64 and side edge 65, front relief 66 and side relief 67. Cutting was carried out in the manner shown in FIG. 6B. Bite 61 cuts the rod of alloy 68 rotated in the direction shown by the arrow at its front and side edges (see FIG. 6A), producing chip 69 of the alloy.

Figure 7:
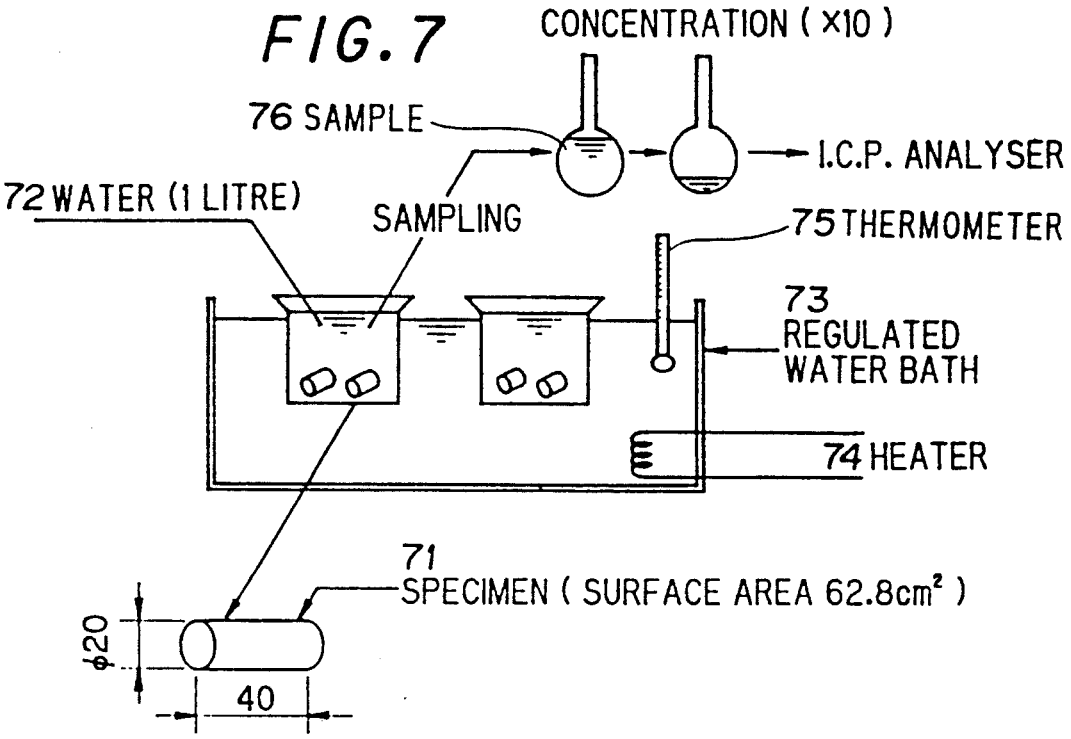
FIG. 7 is an explanatory view showing the method used for the lead dissolution test.

Round rods of 20 mm in diameter and 40 mm in length thus prepared were degreased and washed thoroughly, and then used as the specimen for the lead dissolution tests carried out according to the procedure illustrated in FIG. 7. Two pieces of the alloy specimen 71 were immersed in 1 liter of water 72 kept at a contant temperature, 23° C. or 72° C., in water bath 73 furnished with heater 74 and thermometer 75. Samples 76 of water were taken out after 12, 24, 48 and 72 hours, respectively, and concentrated to 1/10 in volume and supplied to an I.C. P. (induction-coupled plasma atomic emission) analyser. Three kinds of water each having the quality shown in Table 9 were used for the lead dissolution tests. The immersion was carried out at 23° C. and 72° C. The concentration of lead in the water after the immersion determined by induction-coupled plasma atomic emission analysis are shown in FIGS. 8 to 13.

TABLE 9

| Item | Water A | B | C |
|---|---|---|---|
| pH | 7.0 | 7.13 | 8.2 |
| Calcium hardness (ppm) | 92.0 | 30.0 | 0 |
| Inorganic carbon (ppm) | 22.8 | 7.9 | 11.2 |
| Free chlorine (ppm) | <0.05 | 1.1 | 2.0 |
| Total alcali (ppm) | 98.6 | 34.4 | 472 |
| Conductivity ($\mu$mho/cm) | 400 | 70 | 700 |

Figure 8:
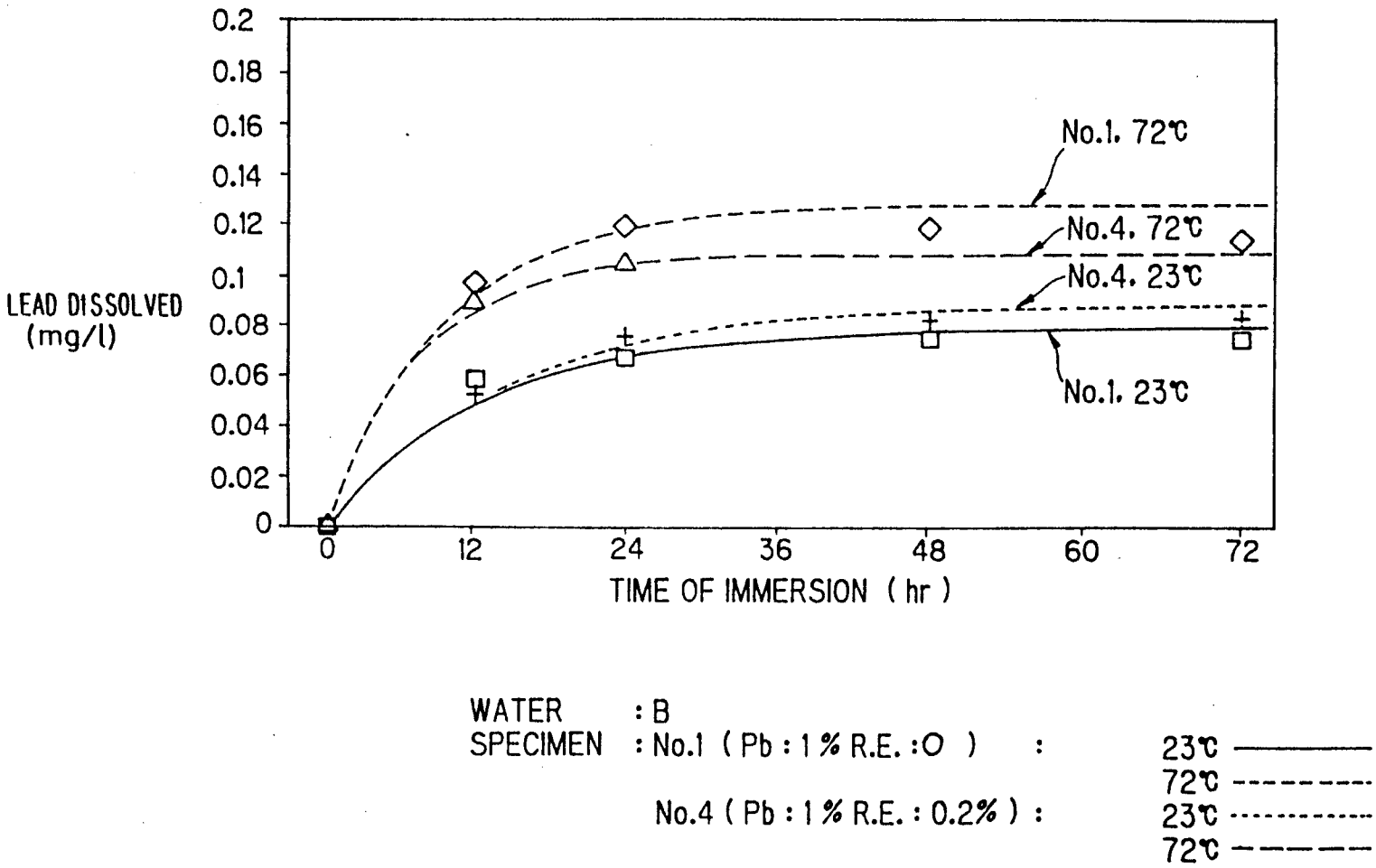
FIG. 8 and FIG. 9 are graphs showing the results of the lead dissolution test for an alloy according to the invention and a conventional lead-bearing brass.
Figure 9:
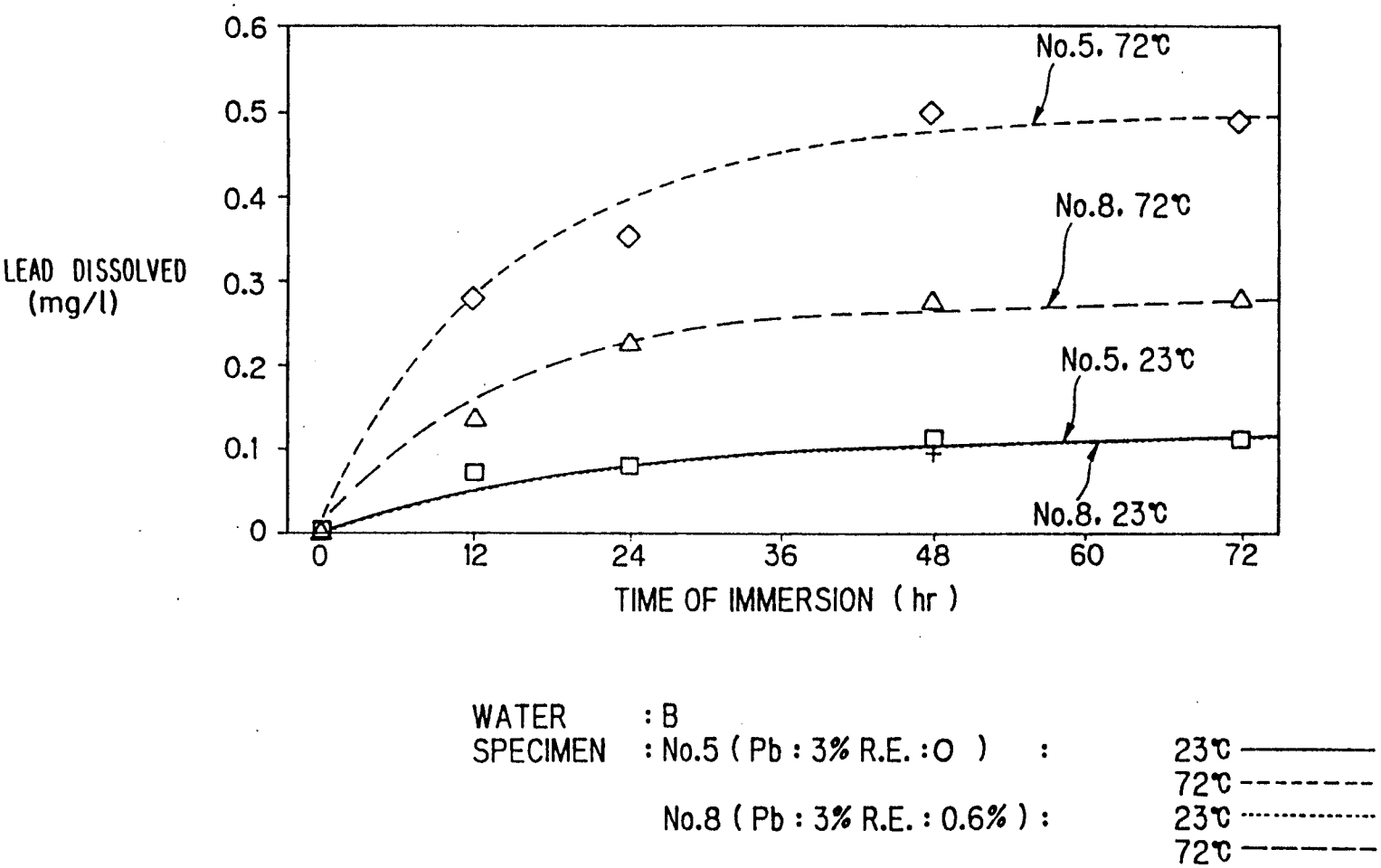
Figure 10:
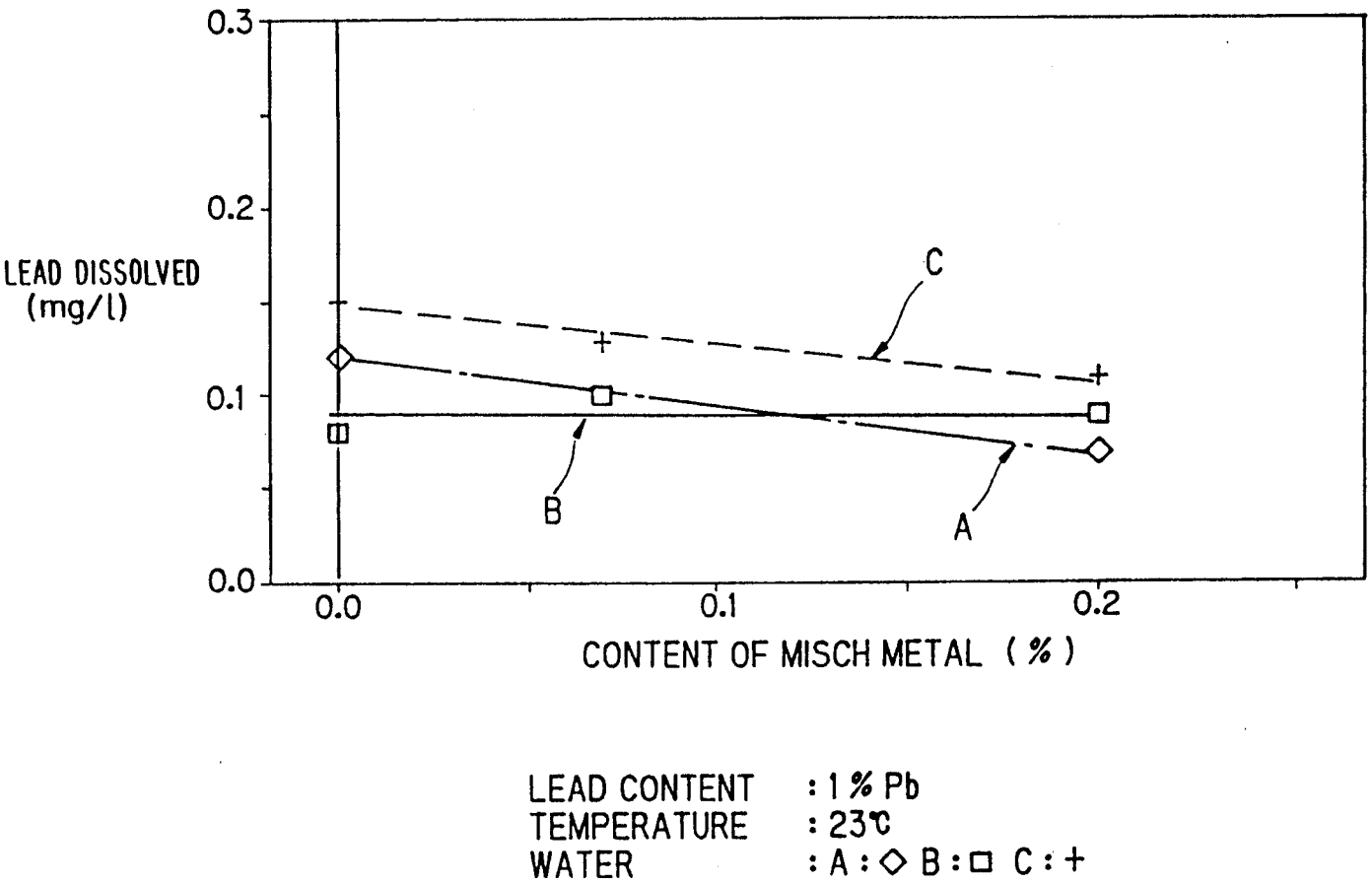
FIG. 10 and FIG. 11 are graphs showing the relation between lead dissolution and content of Misch metal in alloys according to the invention and a conventional lead-bearing brass.
Figure 11:
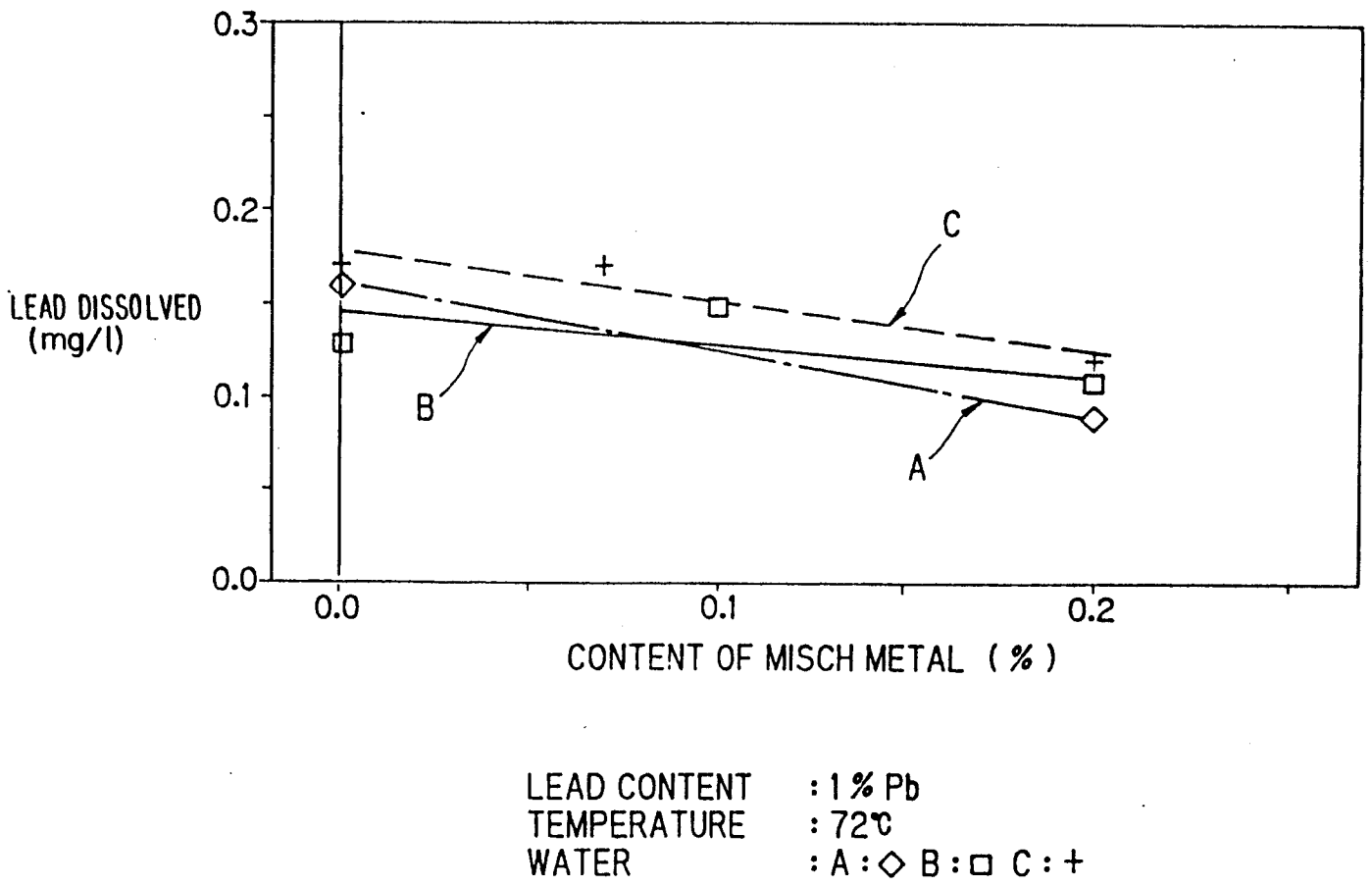
Figure 12:
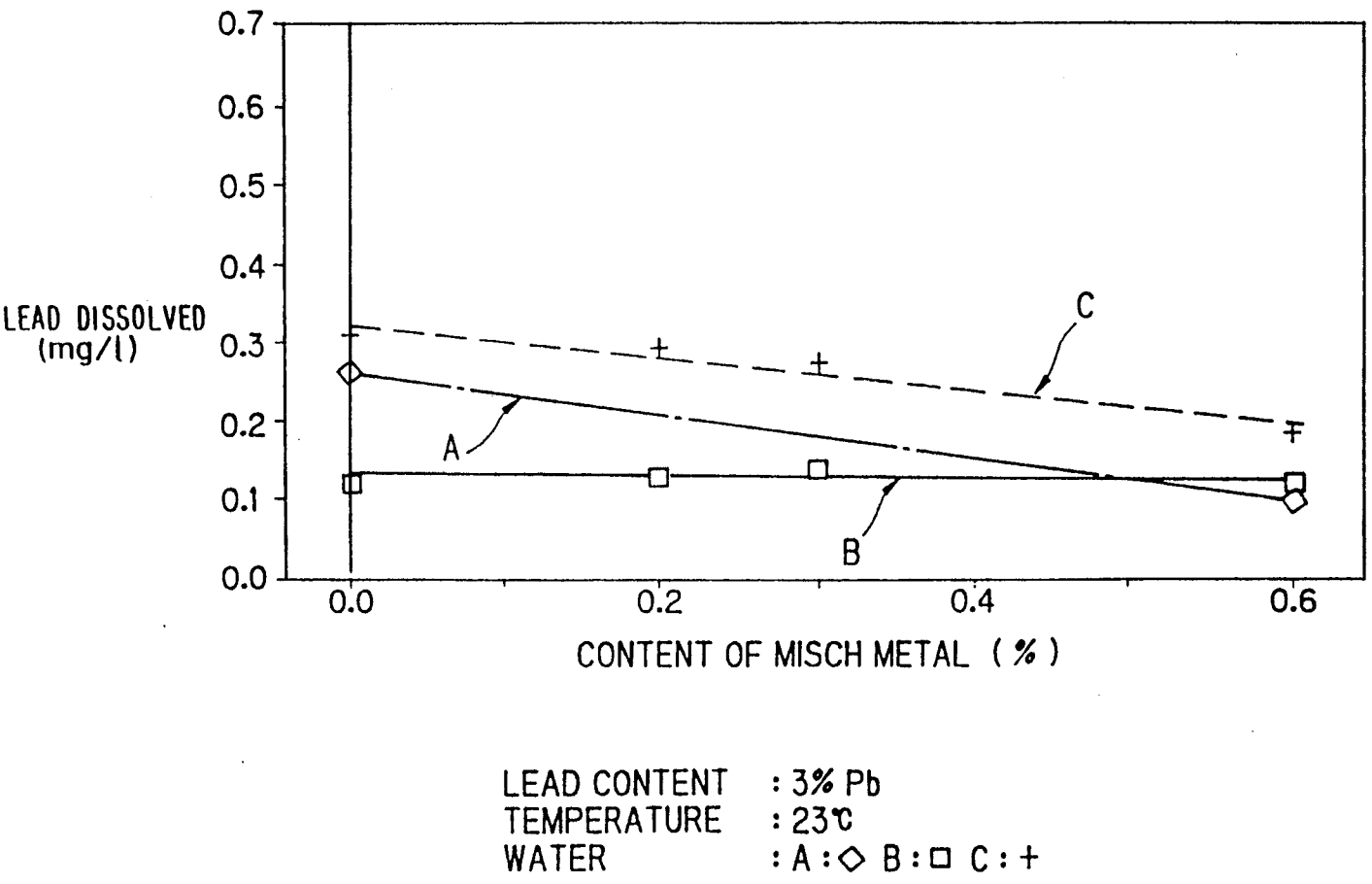
FIG. 12 and FIG. 13 are graphs showing the relation between lead dissolution and content of Misch metal in alloys according to the invention and a conventional lead-bearing brass.
Figure 13:
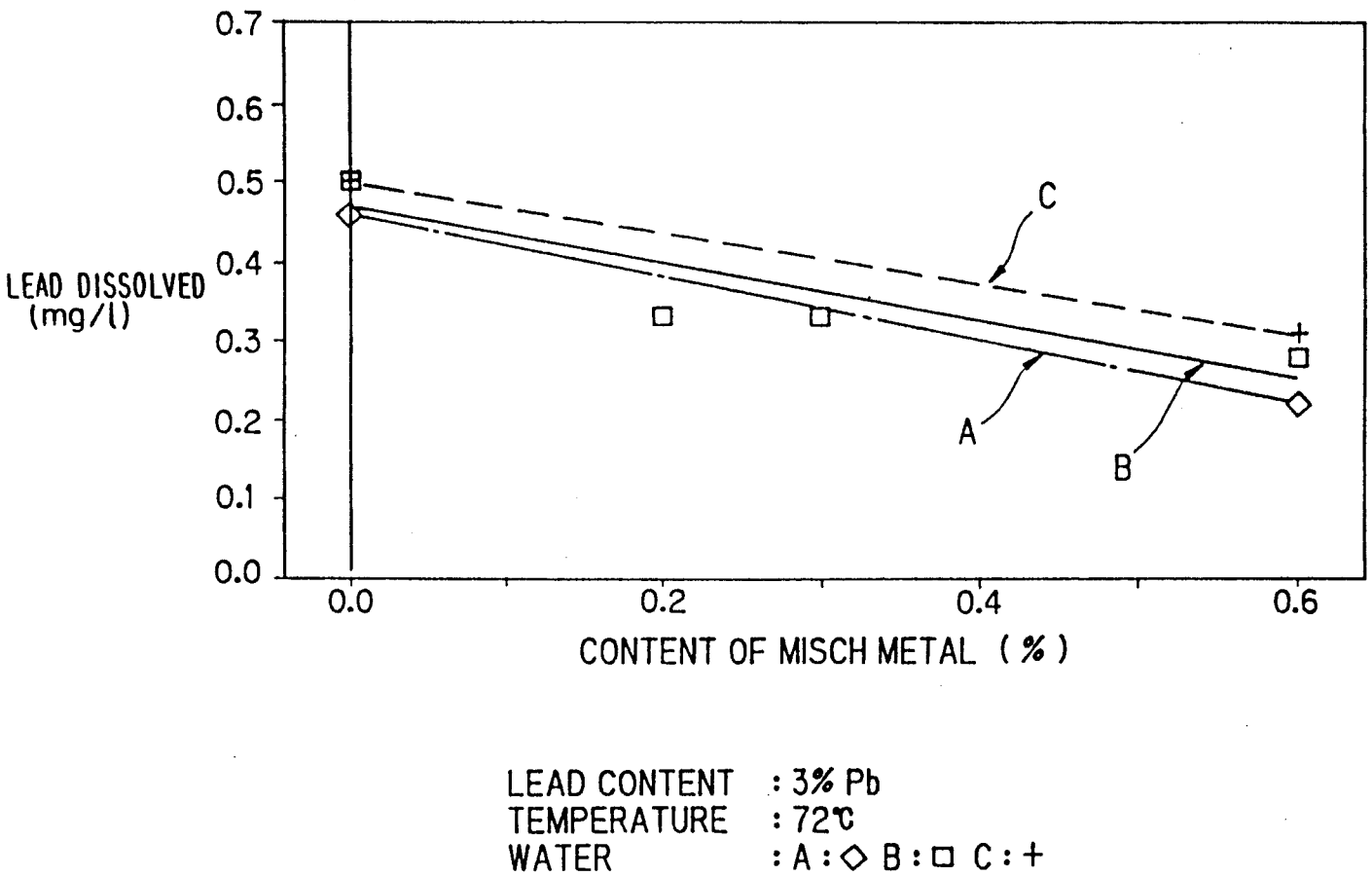

The results for samples 1 and 4 immersed in water B are shown in FIG. 8 in which the concentration of lead in water is plotted as a function of time, while FIG. 9 shows the results for samples 5 and 8 immersed in water B. FIG. 10 shows the relation between the concentration of lead in the water after immersion for 72 hours at the temperature of 23° C. and Misch metal content in the alloy of samples 1 to 4 (containing 1% of lead). FIG. 11 shows such relation at the temperature of 72° C., FIGS. 12 and 13 show such relation for samples 5 to 8 (containing 3% of lead) immersed in water B at 23° C. and 72° C., respectively. FIG. 8 and FIG. 9 indicate that the concentration of lead in the water reaches a saturation after 24 or 48 hours, and the lead dissolution are greater for the alloy containing 3% of lead than that containing 1% and for the higher temperature. It is indicated that the addition of Misch metal inhibits lead from dissolution into water at 72° C., more effectively for the alloy containing 3% of lead compared to that containing 1%, though the effect is obscure for water at 23° C.

FIGS. 8 to 13 indicate that the concentration of lead dissolved in water tends to decrease with the greater amount of Misch metal (at most 1/5 to lead) added to the alloy. This tendency is more remarkable for elevated water temperature and for the higher lead content of 3% compared to that of 1%. The concentration of lead dissolved in water depends on the kind of water, being less for water B, higher for water C. This dependency may be attributed, at least partly, to the conductivity of water which is lower for water B, higher for water C.

HOT FORGING TESTS

Ingots of alloys each having the composition shown in Table 10 were prepared and formed into round rods for hot forging tests (R.E. denotes Misch metal). Alloys 11, 15 and 19 are conventional lead-bearing brass without rare earth metals, alloys 12 to 14 and 16 to 18 are the alloys according to the invention, while alloys 20 to 22 are similar alloys which contain 3 weight % of lead.

The sample of each alloy for hot forging tests was prepared by the following procedure. Brass consisting of 60 weight % of copper and 40 weight % of zinc was melted by low frequency induction furnace; a predetermined amount of lead and Misch metal (R.E.) was added to the melt; the melt was casted semi-continuously in a vertical mold to form an ingot of 115 mm in diameter, the ingot was hot-extruded to form a round rod of 28 mm in diameter and reduced in diameter by cold drawing to 25 mm, annealed and cut into pieces of 35 mm in length. Hot forging was carried out in a manufacturing line at a temperature of 690° C. to 720° C.

TABLE 10

| Alloy No. | Chemical composition (wt. %) | | | | |
|---|---|---|---|---|---|
| | Cu | Pb | R.E. | Zn | R.E./Pb |
| 11 | 59.4 | 0.98 | — | rest | — |
| 12 | 59.6 | 1.03 | 0.07 | rest | 1/15 |
| 13 | 59.6 | 1.03 | 0.09 | rest | 1/11 |
| 14 | 59.5 | 1.01 | 0.20 | rest | 1/5 |
| 15 | 59.6 | 1.48 | — | rest | — |
| 16 | 59.4 | 1.52 | 0.09 | rest | 1/17 |
| 17 | 59.4 | 1.47 | 0.16 | rest | 1/9 |
| 18 | 59.5 | 1.47 | 0.31 | rest | 1/5 |
| 19 | 59.5 | 3.04 | — | rest | — |
| 20 | 59.5 | 3.05 | 0.20 | rest | 1/15 |
| 21 | 59.5 | 2.96 | 0.31 | rest | 1/10 |
| 22 | 59.5 | 3.05 | 0.60 | rest | 1/5 |

The appearance of the formed specimen was observed to look for cracks and flashes on the surface, and the gloss of the surface was evaluated. The occurence of cracks on the surface of each specimen is shown in Table 11, where ++ shows the presence of cracks, + shows hair cracks on the surface only, and numbers in the parentheses show the specimen numbers.

TABLE 11

| R.E./Pb ratio | Pb (weight %) | | |
|---|---|---|---|
| | about 1 | about 1.5 | about 3 |
| 0 | ++(11) | ++(15) | ++(19) |
| about 1/15 | (12) | (16) | ++(20) |
| about 1/10 | (13) | (17) | ++(21) |
| 1/5 | (14) | (18) | +(22) |

No cracks were observed on the surfaces of alloys containing lead less than 3% and Misch metal.

Alloys containing 3% of lead suffered from cracks, including hair cracks observed on the surface of the alloy 22 which contains Misch metal in a weight ratio of 1/5 to lead. Lead-bearing brass without Misch metal (alloys 11, 15 and 19) suffered from cracks, accompanied with flashes of irregular forms (not shown in the table).

MACHINABILITY TESTS

Alloys of compositions shown in Table 12 were prepared (R.E. denotes Misch metal) and formed into round rods for machinability tests. Alloys 33 and 34 are conventional lead-bearing brass without rare earth aetals, alloys 31 and 32 are the alloys according to the invention, while alloys 35 and 36 are similar alloys which contain 3 weight % of lead.

TABLE 12

| Alloy | Chemical composition (wt. %) | | | | |
|---|---|---|---|---|---|
| | Cu | Pb | R.E. | Zn | R.E./Pb |
| *31 | 59.5 | 2.0 | 0.13 | rest | 1/15 |
| *32 | 59.5 | 1.0 | 0.13 | rest | 1/8 |
| #33 | 59.5 | 2.0 | — | rest | — |
| #34 | 59.5 | 1.0 | — | rest | — |
| #35 | 59.5 | 3.0 | 0.13 | rest | 1/23 |
| #36 | 59.5 | 3.0 | 1.48 | rest | 1/2 |

*alloys according to this invention
#comparative or conventional alloys

Alloys were prepared in the same manner as in Example 3. The specimen for machinability test of each alloy was prepared by the following procedure. An ingot of 30 mm in diameter was hot-extruded to form a round rod of 7.5 mm in diameter, reduced in diameter by cold drawing to 6.5 mm, annealed and subjected to cold-drawing again so that a round rod of 6.0 mm in diameter was prepared. The specimen of the alloy of Example 1 and alloy C-1 described before were also prepared in the same manner.

Figure 6B:
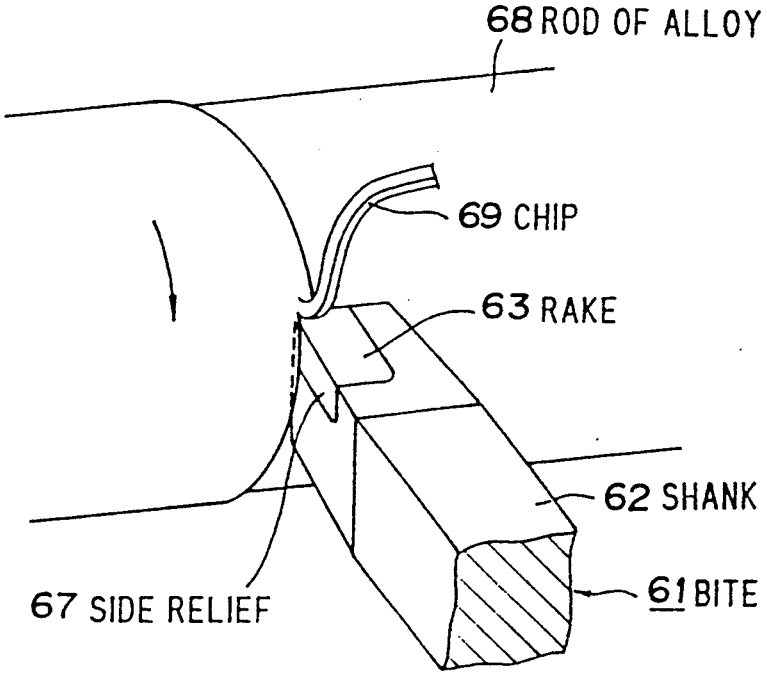

Cutting was carried out at a speed of 2000 revolutions per minute and a feed rate of 0.1 mm per revolution, to the depth of cut of 1.0 or 1.5 mm, making use of a bite of tungsten carbide as shown in FIG. 6A and FIG. 6B. The length and curling diameter of the chips produced in cutting were measured. The results are shown in Table 13, where the chip lengths are classified into four classes, of which 'SS' represents a length not more than 3 mm, 'S' represents 3 to 10 mm, 'SL' represents 10 to 40 mm, and 'L' represents 40 to 120 mm. Curling diameters are classified into 's' representing smaller than 3 mm, 'm' representing 3 to 10 mm, and 'l' representing greater than 10 mm.

TABLE 13

| Alloys | Chip length | | Curling diameter | |
|---|---|---|---|---|
| | Depth 1 mm | Depth 1.5 mm | Depth 1 mm | Depth 1.5 mm |
| *Example 1 | SS | SS | s | s |
| *Alloy 31 | SS + S | SS + S | s | s |
| *Alloy 32 | SS + S | SS + S | s | s |
| #Alloy C1 | S | S | s | s |
| #Alloy 33 | SL + S | L + SL | s | s |
| #Alloy 34 | SL + S | SL + S | s | s |
| #Alloy 35 | S | S | s | s |
| #Alloy 36 | SL | SS + S | l | l |

As indicated in Table 13, the alloys of this invention as well as alloy 35 have free cutting property, equal or superior to conventional lead-bearing brass (alloys 33 and 34). But alloy 36 containing Misch metal in the weight ratio of 1/5 to lead is degraded in free cutting property.

From these results of Examples and tests, it is concluded that the addition of 1/17 to 1/5 in weight relative to lead of Misch metal to Cu-Zn-Pb alloy containing 0.5 to 3.5 weight % of lead produces more finely dispersed phase compared to that in lead-bearing brass without Misch metal, forming intermetallic compounds of lead with rare earth metals, the dispersed phase consisting of free lead being very rare; restrains dissolution of lead into water, especially hot water; provides with an excellent free cutting property; and prevents the alloy from fracture due to hot forging, provided the lead content of the alloy is less than 3.0 weight %. The restraining of lead from dissolving out into water may be attributed to the formation of intermetallic compounds of lead with rare earth metals which inhibits the dispersed phase consisting of free lead from forming and may serve to combine free lead, if it is present, at least partly. The freedom from fracture in hot forging of the alloy of this invention containing at least 0.5 weight % but less than 3.0 weight % of lead may be attributed to the comparatively fine dispersion of lead-bearing phase by the addition of a rare earth metal.

The alloy according to the invention has less tendency for lead to dissolve into water in no relation to the quality and the temperature of water, and is free from gravity segregation and uneven distribution of lead within an ingot in casting and from cracks caused by cold and hot working. In addition, the alloy according to the invention has improved free cutting property. The alloy of the invention is suited for use in devices for water service, such as tap water supply, taking advantage of less tendency for lead to dissolve into water, in no relation to the quality and the temperature of water. The alloy according to the invention containing at least 0.5 weight % but less than 3.0 weight % of lead is free from fracture and cracks caused by hot forging.

Although the invention has been described with respect to specific embodiments for complete and clear disclosure, the appended claims are not to thus limited but are to be construed as embodying all modifications and alternative constructions that may occur to one skilled in the art which fairly fall within the basic teaching herein set forth.

What is claimed is:

1. An alloy for use in water service, consisting of:

57 to 61 weight % of copper;

0.5 to 3.0 weight % of lead;

at least one metal selected from rare earth metals in an amount of 1/17 to 1/5 relative to said lead in weight; and zinc for the rest;

wherein an intermetallic compound is formed between said at least one metal and said lead to reduce an amount of lead which is dissolved into water.

2. An alloy for use in water service, according to claim 1, wherein:

said at least one metal is selected from lanthanum, cerium, praseodymium, neodymium and misch metal.

3. An alloy according to claim 1 having an improved hot forging property, wherein said lead is:

at least 0.5 weight % but less than 3.0 weight %.

4. An alloy as defined in claim 3 wherein said alloy contains greater than 0.5% but at most 2.0% of lead.

* * * * *